US007050027B1

(12) United States Patent
Macrae

(10) Patent No.: US 7,050,027 B1
(45) Date of Patent: May 23, 2006

(54) SINGLE WIRE INTERFACE FOR LCD CALIBRATOR

(75) Inventor: Calum Macrae, Sunnyvale, CA (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 101 days.

(21) Appl. No.: 10/759,927

(22) Filed: Jan. 16, 2004

(51) Int. Cl.
*G09G 3/36* (2006.01)

(52) U.S. Cl. ..... 345/87; 345/211; 324/770

(58) Field of Classification Search ..... 345/87–104, 345/211–213; 324/770
See application file for complete search history.

(56) References Cited

U.S. PATENT DOCUMENTS

| | | | | |
|---|---|---|---|---|
| 4,429,305 | A | 1/1984 | Hosokawa et al. | |
| 4,779,086 | A | 10/1988 | Kanno et al. | |
| 4,902,964 | A | 2/1990 | Szabela et al. | |
| 5,206,633 | A | 4/1993 | Zalph | |
| 5,245,326 | A | 9/1993 | Zalph | |
| 5,369,432 | A | 11/1994 | Kennedy | |
| 5,426,447 | A | 6/1995 | Lee | |
| 5,570,108 | A | 10/1996 | McLaughlin et al. | |
| 5,623,277 | A | 4/1997 | Lippmann et al. | |
| 5,640,174 | A | 6/1997 | Kamei et al. | |
| 5,650,844 | A | 7/1997 | Aoki et al. | |
| 5,696,550 | A | 12/1997 | Aoki et al. | |
| 5,748,171 | A | 5/1998 | Ishizaki et al. | |
| 5,754,150 | A | 5/1998 | Matsui | |
| 5,793,221 | A | 8/1998 | Aoki | |
| 5,861,861 | A | 1/1999 | Nolan et al. | |
| 5,959,604 | A | 9/1999 | Mosier | |
| 5,977,940 | A | 11/1999 | Akiyama et al. | |
| 6,067,065 | A | 5/2000 | Worley, III et al. | |
| 6,069,620 | A | 5/2000 | Nakamura et al. | |
| 6,141,092 | A | 10/2000 | Kim | |
| 6,201,523 | B1 * | 3/2001 | Akiyama et al. | 345/96 |
| 6,229,510 | B1 | 5/2001 | Kim et al. | |
| 6,271,825 | B1 | 8/2001 | Greene et al. | |
| 6,285,345 | B1 | 9/2001 | Crossland et al. | |
| 6,298,066 | B1 * | 10/2001 | Wettroth et al. | 370/449 |
| 6,310,599 | B1 | 10/2001 | Bril et al. | |
| 6,392,630 | B1 | 5/2002 | Lin et al. | |
| 6,538,630 | B1 | 3/2003 | Tanaka et al. | |
| 6,618,076 | B1 | 9/2003 | Sukthankar et al. | |
| 6,664,907 | B1 | 12/2003 | Knepper et al. | |
| 6,677,925 | B1 * | 1/2004 | Kawaguchi et al. | 345/98 |

(Continued)

FOREIGN PATENT DOCUMENTS

JP 05-197352 8/1993

(Continued)

*Primary Examiner*—Alexander Eisen
*Assistant Examiner*—Monica Harris
(74) *Attorney, Agent, or Firm*—Blakely, Sokoloff, Taylor & Zafman LLP

(57) ABSTRACT

A calibration circuit and related method for adjusting a common electrode voltage Vcom of a liquid crystal display (LCD) in response to commands received by way of a single-wire interface. The calibration circuit includes a controller to receive and interpret commands in the form of positive and negative pulses for respectively increasing and decreasing Vcom by a predetermined amount per pulse. The calibration circuit also includes a counter for generating a count related to Vcom, wherein the controller causes the count to decrement and increment in response to the positive and negative command pulses. The calibration circuit further includes a non-volatile memory for storing the count, wherein the controller causes the count to be stored into the non-volatile memory in response to another command in the form of a voltage above a predetermined threshold. This voltage is also used for programming the non-volatile memory.

48 Claims, 4 Drawing Sheets

U.S. PATENT DOCUMENTS

| | | | | |
|---|---|---|---|---|
| 6,714,179 | B1 | 3/2004 | Waterman | |
| 6,738,035 | B1 | 5/2004 | Fan | |
| 6,784,863 | B1 * | 8/2004 | Yanagi et al. | 345/96 |
| 6,795,046 | B1 | 9/2004 | Janssen et al. | |
| 6,809,718 | B1 | 10/2004 | Wei et al. | |
| 2002/0101415 | A1 | 8/2002 | Song | |
| 2002/0180674 | A1 | 12/2002 | Waterman et al. | |
| 2003/0020724 | A1 | 1/2003 | O'Donnell | |
| 2003/0231155 | A1 | 12/2003 | Ogawa | |
| 2004/0036666 | A1 * | 2/2004 | Tsutsui et al. | 345/87 |
| 2004/0207592 | A1 * | 10/2004 | Ludden | 345/96 |
| 2004/0233082 | A1 | 11/2004 | Yoo | |
| 2005/0012874 | A1 | 1/2005 | Wu et al. | |

FOREIGN PATENT DOCUMENTS

| | | |
|---|---|---|
| JP | 11-295357 | 10/1999 |
| JP | 2002-296556 | 10/2002 |

* cited by examiner

SINGLE WIRE INTERFACE FOR LCD CALIBRATOR

FIELD OF THE INVENTION

This invention relates generally to liquid crystal displays (LCDs), and in particular, to a single wire interface for an LCD calibrator.

BACKGROUND OF THE INVENTION

The production of LCDs typically entails manufacturing the LCDs, and subsequently testing and adjusting LCDs. During the testing and adjustment of the LCDs panels, various parameters of the LCDs are adjusted to fine tune the displaying operation of the LCDs. One such parameter, in particular, is the common electrode voltage Vcom of the LCDs. As is explained below with reference to FIG. 1, the common electrode voltage Vcom affects the display characteristics of an LCD, including the flicker characteristic.

FIG. 1 illustrates a block diagram of a typical LCD 100. The LCD 100 consists of a data signal line driver 102 to generate data voltages for pixels in common columns respectively by way of a plurality of data lines (DL#). The LCD 100 further consists of a scan signal line driver 104 to generate select line voltages for pixels in common rows respectively by way of a plurality of select lines (SL#). Each pixel 106 consists of a field effect transistor (FET) having a gate (G) electrically coupled to the corresponding select line, a drain (D) electrically coupled to the corresponding data line, and a source (S) electrically coupled to a segment electrode of a liquid crystal (LC) medium. A common electrode voltage Vcom, common to all of the pixels, is applied to a common electrode of the LC medium.

The LCD 100 further consists of a common electrode voltage adjustment circuit 108 consisting of a voltage divider including resistor R1 and variable resistor R2 connected in series between a supply voltage Vcc and ground. The intermediate node between the resistors R1 and R2 is coupled to a buffer 110 to generate the common electrode voltage Vcom.

During a frame cycle, the scan signal line driver 104 sequentially activates the select lines (SL) to respectively display the frame lines. For each activated select line (SL), the data signal line driver 102 activates the data lines (DL) depending on which pixels are to be activated based on the input image data. A pixel is activated if both the corresponding select line (SL) and corresponding data line (DL) are activated, causing the corresponding FET to turn "on", thereby generating a current through the liquid medium (LC).

As previously discussed, the common electrode voltage Vcom affects the illumination characteristics of the pixels, such as the flicker characteristics. During testing, a technician manually adjusts the resistor R2 to set the desired common electrode voltage Vcom voltage while monitoring a test pattern displayed by the LCD. Once the desired common electrode voltage Vcom is set and all other parameters are tested and adjusted, the LCD unit is securely packaged and future access to such adjustments are not typically undertaken due to difficulties in obtaining access to such components after the LCD unit is securely packaged.

Accordingly, it is desirable to provide an interface which facilitates the electronic adjustment of such parameters. In addition, it is further desirable that such an interface include as minimal contacts for coupling to an external programming unit.

SUMMARY OF THE INVENTION

An aspect of the invention relates to a calibration circuit for adjusting a common electrode voltage Vcom of a liquid crystal display (LCD) in response to commands received by way of a single-wire interface. The calibration circuit includes a controller to receive and interpret commands in the form of positive and negative pulses for increasing and decreasing the common electrode voltage Vcom by a predetermined amount per pulse. The calibration circuit includes a counter for generating a count related to the Vcom, wherein the controller causes the count to increment and decrement in response to the negative and positive command pulses. The calibration circuit further includes a non-volatile memory for storing the count, wherein the controller causes the count to be stored into the non-volatile memory in response to another command in the form of a voltage above a predetermined threshold. This voltage is also used for programming the non-volatile memory.

Another aspect of the invention relates to method of adjusting a common electrode voltage, Vcom of a liquid crystal display (LCD), comprising receiving a first command to increase the common electrode voltage Vcom by way of a single-wire interface; increasing the common electrode voltage Vcom in response to the first command; receiving a second command to decrease the common electrode voltage Vcom by way of the single-wire interface; and decreasing the common electrode voltage Vcom in response to the second command. This method may further entail receiving a third command to store a count related to the common electrode voltage Vcom in a non-volatile memory by way of the single-wire interface; and storing the count in the non-volatile memory in response to the third command.

Other aspects, features and techniques will become apparent to one skilled in the relevant art in view of the following detailed description of the invention.

DETAILED DESCRIPTION OF THE INVENTION

Figure 1:
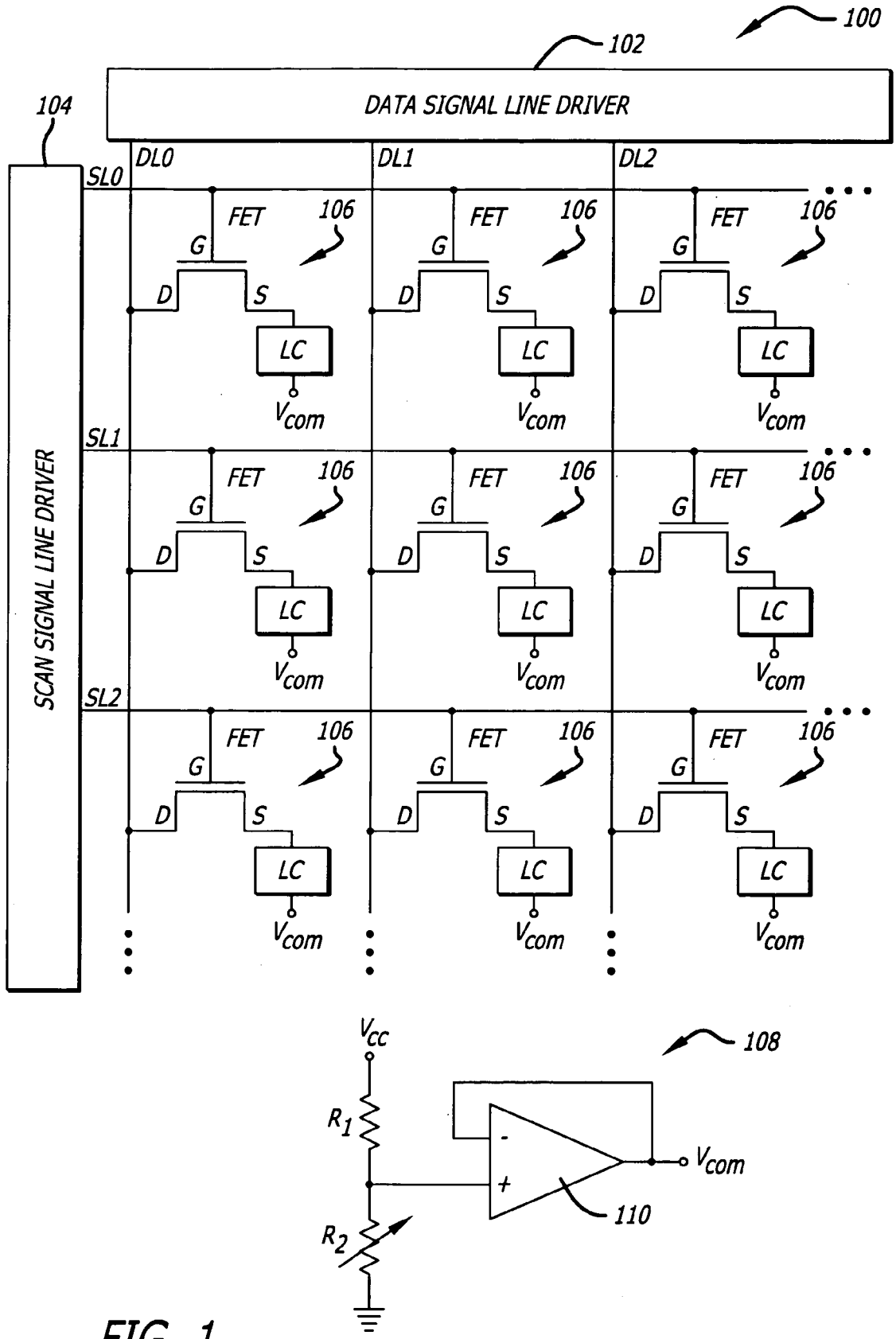
FIG. 1 illustrates a block diagram of a typical LCD.
Figure 2:
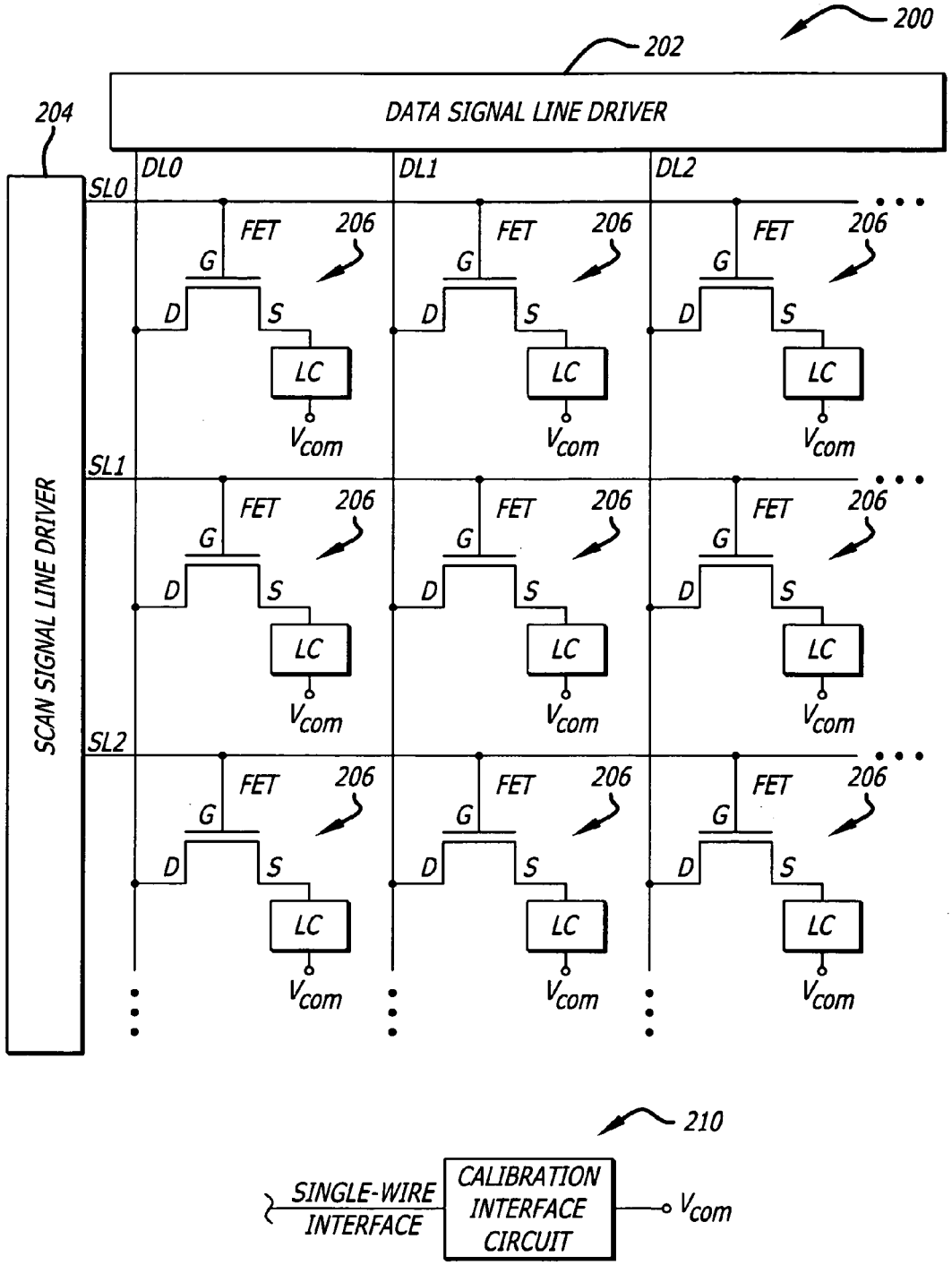
FIG. 2 illustrates a block diagram of an exemplary LCD in accordance with an embodiment of the invention.

FIG. 2 illustrates a block diagram of an exemplary LCD 200 in accordance with an embodiment of the invention. The LCD 200 comprises a data signal line driver 202 to generate data voltages for pixels in common columns respectively by way of a plurality of data lines (DL#). The LCD 200 further comprises a scan signal line driver 204 to generate select line voltages for pixels in common rows respectively by way of a plurality of select lines (SL#). Each pixel 206 comprises a switching element such as FET having a gate (G) electrically coupled to the corresponding select line, a drain (D) electrically coupled to the corresponding data line, and a source (S) electrically coupled to a segment electrode of a liquid crystal (LC) medium. A common electrode voltage Vcom, common to all of the pixels, is applied to a common electrode of the LC medium.

As discussed in the Background section, the common electrode voltage Vcom affects the illumination characteristics of the pixels, such as the flicker characteristics. Accordingly, for adjusting the common electrode voltage Vcom, the exemplary LCD 200 further comprises a calibration interface circuit 210 having an interface to receive external commands for programming the common electrode voltage Vcom, and an output for generating the common electrode voltage Vcom. As is discussed in further detail below, the calibration interface circuit 210 receives a set of commands for adjusting the common electrode voltage Vcom, and another command for causing the desired level for the common electrode voltage Vcom to be rewritten to a non-volatile memory. In the exemplary embodiment, the calibration interface circuit 210 receives these commands by way of a single-wire interface.

Figure 3:
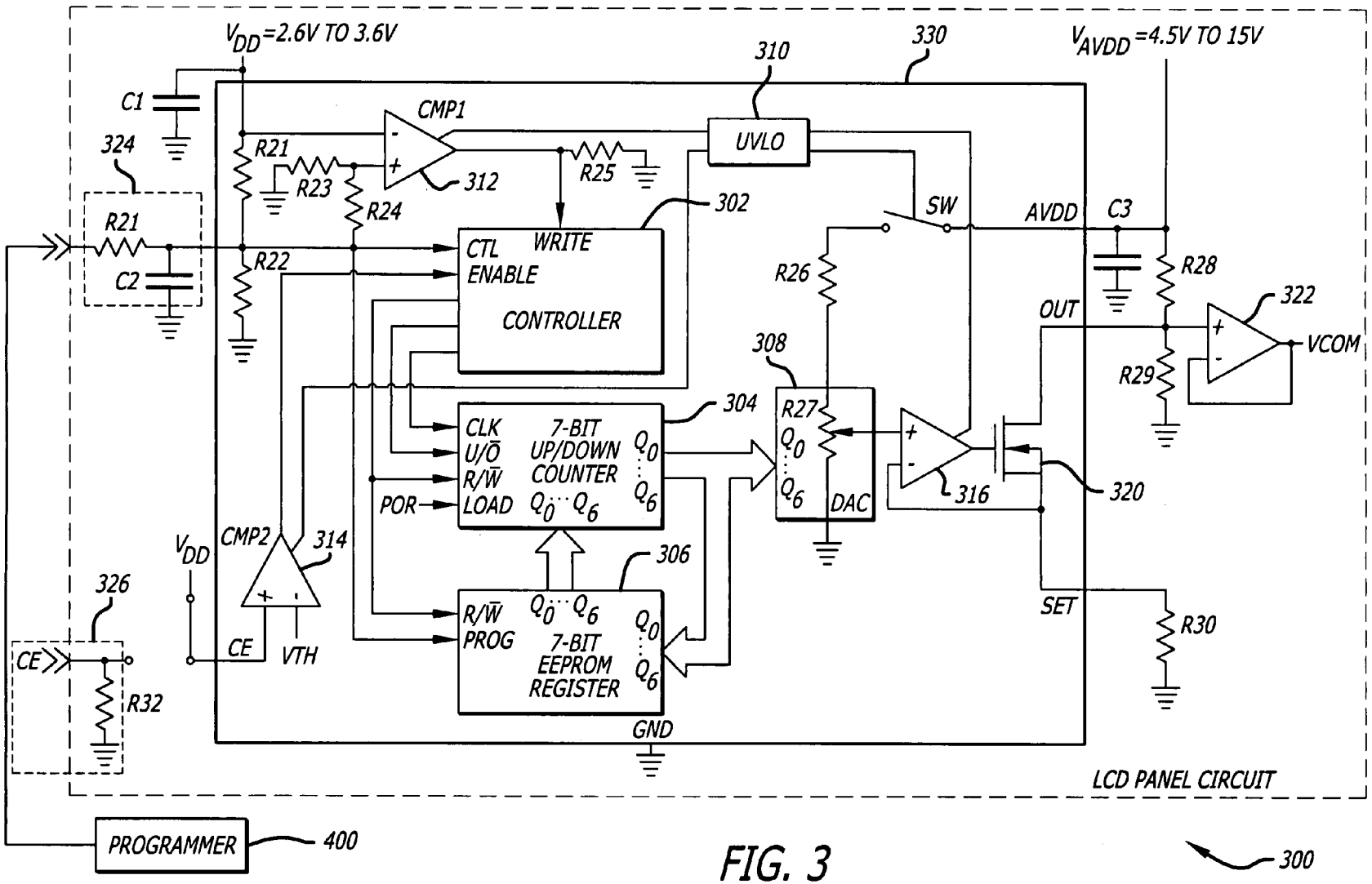
FIG. 3 illustrates a block diagram of an exemplary calibration interface circuit in accordance with another embodiment of the invention.

FIG. 3 illustrates a block diagram of an exemplary calibration interface circuit 300 in accordance with another embodiment of the invention. The calibration interface circuit 300 comprises a controller 302, an up/down counter 304, a non-volatile memory such as the electrically erasable programmable read only memory (EEPROM) 306, a digital-to-analog converter (DAC) 308, an under voltage lock out (UVLO) circuit 310, comparators 312 and 314, buffer 316, a field effect transistor (FET) 320, and a plurality of resistors R21–R26. These elements of the calibration interface circuit 300 may be packaged as a single integrated circuit 330.

The exemplary calibration interface circuit 300 further comprises an electrostatic discharge (ESD) protection circuit 324 configured as a low pass filter having a resistor R21 and a capacitor C2, a calibrator enable (CE) circuit 326 including resistor R32, a buffer 322, a voltage divider including resistors R28 and R29, a current-setting resistor R30, and a plurality of bias line filtering capacitors C1 and C3. These elements of the calibration interface circuit 300 may be connected externally to the integrated circuit 330.

The controller 302 includes a control input (CTL) to receive commands from an external programming unit 400. The ESD protection circuit 324 is electrically connected between the control input (CTL) of the controller 302 and the programming unit 400. More specifically, the resistor R21 is connected in series between the programming unit 400 and the control input (CTL) of the controller 302, and the capacitor C2 is connected in shunt. As is explained in more detail as follows, the ESD protection circuit 324, being configured as a low pass filter, improving the ESD protection.

The control input (CTL) of the controller 302 is also electrically connected to the intermediate node of a voltage divider comprising resistors R21 and R22 connected between a first supply voltage terminal $V_{DD}$ and a ground terminal. In addition, the control input (CTL) of the controller 302 is electrically connected to the positive input of the comparator 312 via the intermediate node of a voltage divider comprising resistors R23 and R24 connected between the control input (CTL) of the controller 302 and a ground terminal. The control input (CTL) is also electrically connected to the programming input (PROG) of the EEPROM 306. The first supply voltage terminal $V_{DD}$ is electrically connected to the negative input of the comparator 312. The output of the comparator 312 is electrically connected to the write input (WRITE) of the controller 302, and to the shunt resistor R25 serving as a load for the comparator 312.

As is explained in more detail as follows, the voltage divider comprising R21 and R22 is used to set a particular voltage on the positive input of the comparator 312 when there is no signal on the control input (CTL). This biases the CTL voltage at $V_{DD}/2$ when there is no signal on the control input (CTL). The voltage divider comprising resistors R23 and R24 is used to set a minimum voltage on the control input (CTL) of the controller 302 which causes the output of the comparator 312 to be asserted. In this example, the minimum control voltage (CTL) is approximately 1.2 $V_{DD}$.

The enable input (ENABLE) of the controller 302 is electrically connected to the output of comparator 314. The comparator 314 includes a negative input to receive a predetermined threshold voltage $V_{TH}$. The comparator 314 includes a positive input to receive a controller enable (CE) signal. When the controller enable (CE) signal is greater than the threshold voltage $V_{TH}$, the output of the comparator 314 is asserted, thereby asserting the enable input (ENABLE) of the controller 302. When the enable input (ENABLE) of the controller 302 is asserted, the controller 302 responds to commands received via the control input (CTL) for programming the common electrode voltage Vcom. When the enable input (ENABLE) of the controller 302 is not asserted, the controller 302 does not respond to commands received via the control input (CTL) for programming the common electrode voltage Vcom.

The controller enable (CE) may be tied to the first supply voltage terminal $V_{DD}$ (e.g. $V_{DD}>V_{TH}$) using a jumper to maintain the enable input (ENABLE) of the controller 302 asserted to continuously enable the controller 302 for programming the common electrode voltage Vcom. In addition, the controller enable (CE) may be tied to a ground terminal by way of resistor R32 using a jumper to maintain the enable input (ENABLE) of the controller 302 non-asserted to continuously disable the controller 302 from programming the common electrode voltage Vcom. This may be useful to prevent the programming of the common electrode voltage Vcom by unauthorized parties.

The up/down counter 304 includes a clock input (CLK) to receive a clock signal from the controller 302, which is used as a timing signal to sequentially change the count of the up/down counter 304. The up/down counter 304 also includes an up/down input (U/D) 304 to receive a counting direction signal from the controller 302. In addition, the up/down counter 304 also includes a read/write input (R/W) from the controller 302 to selectively fix the count so that it can be written to the EEPROM 306. Additionally, the up/down counter 304 includes a power-on-reset input (POR) to receiver a POR signal which causes the counter 304 to load an input count from the EEPROM 306. Further, the up/down counter 304 includes a count output, coupled to the DAC 308 and the EEPROM 306, to produce the current count. Moreover, the up/down counter 304 includes a count input, coupled to the EEPROM 306, to receive the input count from the EEPROM 306.

The EEPROM 306 includes a read/write input (R/W) to receive the read/write signal from the controller 302 for selectively enabling the EEPROM 306 for storing the current count generated by the up/down counter 304. The EEPROM 306 further includes a programming input (PROG) to receive a programming voltage from the programming unit 400. The EEPROM 306 further includes an input to receive the current count from the up/down counter 304. And, the EEPROM 306 includes an output to provide the stored count to the count input of the up/down counter 304.

The DAC 308 includes an input to receive the current count from the up/down counter 304, and an output to generate a voltage related to the current count. The DAC 308 may use a typical resistor ladder, as represented by resistor R27, to generate the count-related voltage. The resistor ladder R27 is electrically coupled at a first end to a second supply voltage terminal $V_{ADD}$ by way of a resistor R26 and a switch SW, and at a second end to a ground terminal.

The buffering operational amplifier 316 includes a positive input electrically coupled to the output of the DAC 308, a negative input electrically connected to the source of FET 320 and to current-setting resistor R30 connected to a ground terminal, and an output electrically connected to the gate of FET 320. The drain of FET 320 is electrically connected to the positive input of buffering operational amplifier 322, and to the intermediate node of a voltage divider comprising resistors R28 and R29 connected in series between the second supply voltage terminal $V_{ADD}$ and a ground terminal. The buffering operational amplifier 322 includes a negative input connected to its output, as is customary for an operational amplifier configured as a buffer. The common electrode voltage Vcom of the LCD is generated at the output of the operational amplifier 322.

The UVLO 310 includes an output to control switch SW and also includes a plurality of outputs to provide a bias voltage to each of the operational amplifiers 312, 314, and 316. The UVLO senses an under voltage of the supply voltage $V_{DD}$, and opens switch SW if the supply voltage $V_{DD}$ is below a certain threshold. This has the effect of shutting down the operational amplifiers, thereby placing the calibration interface circuit 300 in a low power mode. The shunt-connected capacitors C1 and C3 function is to reduce noise present respectively on the first and second supply voltage terminals $V_{DD}$ and $V_{ADD}$.

Figure 4:
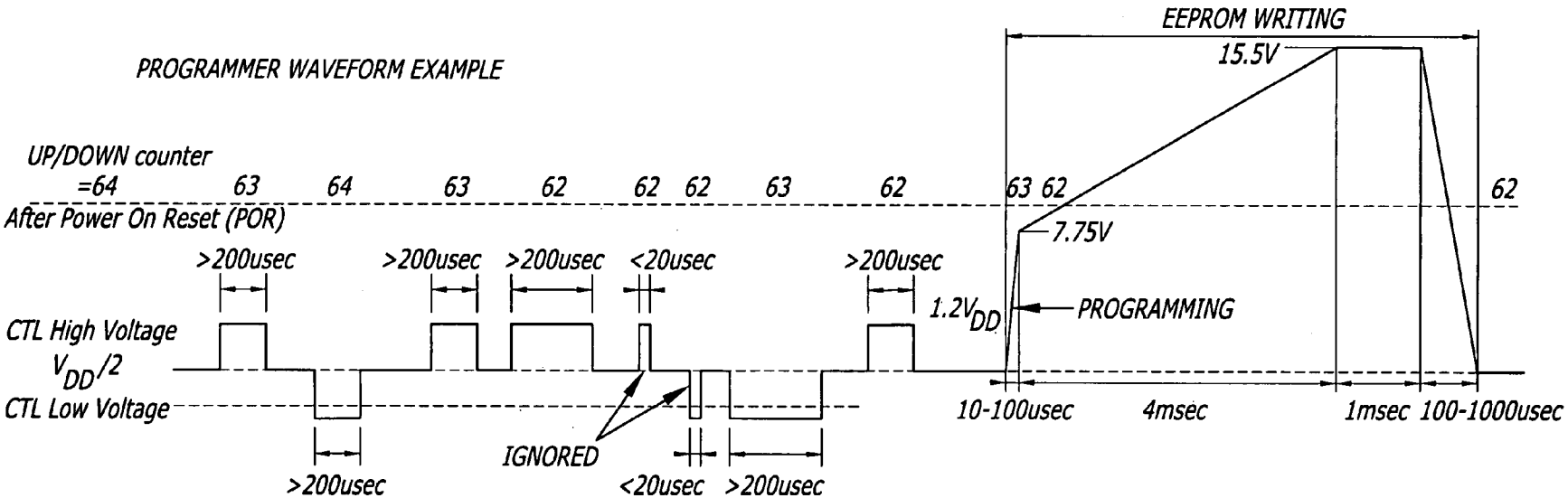
FIG. 4 illustrates a timing diagram of the command signals associated with the exemplary calibration circuit in accordance with another aspect of the invention.

With reference to FIG. 4 which illustrates a timing diagram of the command signals associated with the exemplary calibration circuit 300, the programming unit 400 generates a command to increase the common electrode voltage Vcom by an amount corresponding to a single count in the form of a relatively high voltage pulse having a maximum amplitude above a command-indicating threshold (e.g. $>V_{DD}/2$), a width larger than a predetermined pulse width (e.g. >200 microseconds), and a maximum amplitude lower than the programming voltage threshold (e.g. 1.2 $V_{DD}$). Similarly, the programming unit 400 generates a command to decrease the common electrode voltage Vcom by an amount corresponding to a single count in the form of a relatively low voltage pulse having a minimum amplitude below the command-indicating threshold (e.g. $<V_{DD}/2$), a width larger than a predetermined pulse width (e.g. >200 microseconds), and a maximum amplitude lower than the programming voltage threshold (e.g. 1.2 $V_{DD}$).

Further, the programming unit 400 generates a command to write the current count of the up/down counter 304 to the EEPROM 306 in the form of a voltage greater than a predetermined threshold (e.g. 1.2 $V_{DD}$). That command voltage also serves as the programming voltage for the EEPROM 306 which has a specific voltage and timing consideration (e.g. ramp up from 7.75V to 15.5 V within 4 milliseconds, maintain 15.5V for 1 millisecond, and ramp down to $V_{DD}/2$ within 100–1000 microseconds).

Taking the example given in FIG. 4 and with reference to FIG. 3, assume the count of the up/down counter 304 is at 64 after a power-on-reset (POR). In addition, it is further assumed that the controller enable (CE) signal is asserted so that the controller 302 responds to programming commands.

First, the programming unit 400 generates a command to increase the common electrode voltage Vcom by an amount corresponding to a single count. As shown, this command is in the form of a relatively high voltage pulse with a width greater than 200 microseconds and with a maximum amplitude of less than $1.2*V_{DD}$. In response to this command, the controller 302 disasserts the U/D signal so that the up/down counter 304 decrements the count in response to the clock signal generated by the controller 302. Thus, in response to such relatively high voltage pulse, the count changes from 64 to 63. The lower count causes the DAC 308 to generate a corresponding lower voltage. This lower voltage translates into a lower current through the current-setting resistor R30 due to the operation of the buffer 316 and FET 320 as a current-steering circuit. The lower current causes less voltage drop across resistor R28, thereby causing the common electrode voltage Vcom to increase.

Second, the programming unit 400 generates a command to decrease the common electrode voltage Vcom by an amount corresponding to a single count. As shown, this command is in the form of a relatively low voltage pulse with a width greater than 200 microseconds and with a maximum amplitude of less than 1.2 $V_{DD}$. In response to this command, the controller 302 asserts the U/D signal so that the up/down counter 304 increments the count in response to the clock signal generated by the controller 302. Thus, in response to such relatively low voltage pulse, the count changes from 63 to 64. The higher count causes the DAC 308 to generate a corresponding higher voltage. This higher voltage translates into a higher current through the current-setting resistor R30 due to the operation of the buffer 316 and FET 320 as a current-steering circuit. The higher current causes more voltage drop across resistor R28, thereby causing the common electrode voltage Vcom to decrease.

In the same manner described above, the following two relatively high voltage pulses decrease the count value by two to 62, thereby increasing the common electrode voltage Vcom by an amount corresponding to two counts. Then, according to the example of FIG. 4, the following relatively high (e.g. <20 microseconds) and narrow voltage pulse (which could be noise or interference) has a width less than the requisite minimum pulse width to be recognized as a command. In this case, the controller 302 does not recognize it as a command. This applies also to the following relatively low and narrow voltage pulse. Thus, for these two pulses the count remains at 62, and consequently, the common electrode voltage Vcom remains substantially fixed during this time interval. The relatively narrow voltage pulses are followed by relatively low and high programming pulse.

Once the desired common electrode voltage Vcom has been reached, the EEPROM 306 may be programmed to store the count of the up/down counter 304, which corresponds to the desired common electrode voltage Vcom. To accomplish this, the programming unit 400 initially produces a voltage greater than the predetermined threshold of $1.2*V_{DD}$ (e.g. 7.75 V). The programming voltage, being greater than the predetermined threshold, causes the output of the comparator 312 to be asserted. The asserted write input (WRITE) of the controller 302 causes the controller to assert the R/W output, thereby enabling the up/down counter 304 and the EEPROM 306 for programming the count into the EEPROM 306. Then, the programming voltage continues to increase to, for example, 15.5 V, where it is applied to the programming input of the EEPROM 306 for programming the same with the count.

There are many advantages to the calibration interface circuit 300. First, it provides for the digital tuning of the common electrode voltage Vcom with the use of a programming unit, which may be easier for a test technician. Second, the calibration interface circuit 300 may be configured to provide high resolution adjustment of the common electrode voltage Vcom, thereby providing more control and accuracy in tuning such voltage. Third, the calibration interface circuit 300 uses a single-wire interface, which is desirable to reduce the number of pins on the LCD interface for performing this adjustment operation.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A calibration circuit for adjusting a common electrode voltage Vcom for a liquid crystal display (LCD), comprising a controller to receive a first command for changing said common electrode voltage Vcom by way of a single-wire interface, and to cause said common electrode voltage Vcom to change in response to said first command, the controller having a counter to generate a count related to said common electrode voltage Vcom, and a digital-to-analog converter (DAC) to generate an intermediate voltage related to said count.

2. The calibration circuit of claim 1, further comprising a current-steering circuit to steer a current related to said common electrode voltage Vcom in response to said intermediate voltage.

3. The calibration circuit of claim 2, wherein said current-steering circuit comprises:

a field effect transistor (FET) including a drain, a gate, and a source;

an operational amplifier including a first input to receive said intermediate voltage, a second input coupled to the source of said FET, and an output coupled to the gate of said FET.

4. The calibration circuit of claim 3, further comprising a current-setting resistor coupled to the source of said FET.

5. The calibration circuit of claim 4, further comprising a voltage divider including an intermediate node coupled to a drain of said FET.

6. The calibration circuit of claim 5, further comprising a buffer coupled to said intermediate node of said voltage divider.

7. The calibration circuit of claim 1, further comprising a non-volatile memory for storing said count.

8. The calibration circuit of claim 7, wherein said non-volatile memory comprises an electrically erasable programmable read only memory (EEPROM).

9. The calibration circuit of claim 7, wherein said controller causes said count of said counter to be rewritten into said non-volatile memory in response to a second command received by way of said single-wire interface.

10. The calibration circuit of claim 9, wherein said second command comprises a voltage greater than a predetermined threshold.

11. The calibration circuit of claim 10, further comprising a comparator to compare said second command voltage to said threshold, and to generate a signal for said controller if said second command voltage is greater than said threshold.

12. The calibration circuit of claim 10, wherein said non-volatile memory is configured to receive said second command voltage for use in storing said count into said non-volatile.

13. The calibration circuit of claim 1, wherein said controller includes an enable input for receiving a second command which causes said controller to ignore said first command.

14. The calibration circuit of claim 1, further comprising a low power mode circuit to reduce a power consumption of said calibration circuit.

15. A method of adjusting a common electrode voltage Vcom of a liquid crystal display (LCD), comprising:

generating a count related to said common electrode voltage Vcom;

receiving a first command to change said count in a first direction to increase said common electrode voltage Vcom by way of a single-wire interface;

increasing said common electrode voltage Vcom in response to said count;

receiving a second command to change said count in a second direction to decrease said common electrode voltage Vcom by way of said single-wire interface; and decreasing said common electrode voltage Vcom in response to said count;

receiving a third command to store said count in a non-volatile memory by way of said single-wire interface;

storing said count in said non-volatile memory in response to said third command.

16. The method of claim 15, further comprising decrementing said count in response to said first command.

17. The method of claim 15, further comprising incrementing said count in response to said second command.

18. The method of claim 15, wherein said first command comprises a pulse.

19. The method of claim 18, wherein a maximum amplitude of said pulse is above a predetermined amplitude threshold to indicate that said first command is for increasing the common electrode voltage Vcom.

20. The method of claim 18, wherein a width of said pulse is above a predetermined width threshold to indicate that said pulse is not to be ignored.

21. The method of claim 15, wherein said second command comprises a pulse.

22. The method of claim 21, wherein a minimum amplitude of said pulse is below a predetermined amplitude threshold to indicate that said second command is for decreasing the common electrode voltage Vcom.

23. The method of claim 22, wherein a width of said pulse is above a predetermined width threshold to indicate that said pulse is not to be ignored.

24. The method of claim 15, wherein said third command comprises a voltage above a predetermined voltage threshold.

25. The method of claim 24, further comprising using said voltage to program a storing of said count into said non-volatile memory.

26. The method of claim 15, further comprising:

receiving a pulse by way of said single-wire interface; and ignoring said pulse if a width of said pulse is below a predetermined width threshold.

27. The method of claim 15, further comprising:

receiving a fourth command to disable a processing of said first and second commands;

receiving a fifth command to increase or decrease said common electrode voltage Vcom by way of said single-wire interface; and ignoring said fifth command in response to said fourth command.

28. A calibration circuit for use in adjusting a common electrode voltage Vcom for a liquid crystal display (LCD) comprising:

a controller to receive commands by way of a single-wire interface;

an up/down counter coupled to the controller;

electrically reprogrammable nonvolatile storage coupled to the controller and to an output of the up/down counter;

a digital to analog converter (DAC) having an input coupled to the output of the up/down counter, an output of the DAC being coupled to provide a calibration circuit output;

the up/down counter having a power on reset for resetting the counter to a count stored in the nonvolatile storage on application of power to the calibration circuit;

the controller being responsive to a first command from the single wire interface to cause the counter to increase its count;

the controller being responsive to a second command from the single wire interface to cause the counter to decrease its count;

the controller being responsive to a third command from the single wire interface to cause the nonvolatile storage to store a count from the up/down counter.

29. The calibration circuit of claim 28 wherein the first and second commands are voltage pulses in first and second directions, respectively, of at least a predetermined duration.

30. The calibration circuit of claim 29 wherein the first command is sensed by sensing a voltage from the single wire interface relative to a threshold voltage.

31. The calibration circuit of claim 29 wherein the second command is sensed by sensing a voltage from the single wire interface relative to a threshold voltage.

32. The calibration circuit of claim 29 wherein the first and second commands are each voltage pulses of decreased and increased voltages, respectively.

33. The calibration circuit of claim 32 wherein the third command comprises a programming voltage pulse for the nonvolatile storage.

34. The calibration circuit of claim 33 wherein the third command is a positive going programming voltage pulse of greater amplitude than the second command, the controller being configured to distinguish between the second and third commands by sensing a positive pulse rising to a voltage above a second command voltage in less than the predetermined duration.

35. The calibration circuit of claim 34 wherein the predetermined duration is 200 μsec.

36. The calibration circuit of claim 29 wherein the third command comprises a programming voltage pulse for the nonvolatile storage.

37. The calibration circuit of claim 36 wherein the electrically reprogrammable nonvolatile storage is an EEPROM.

38. The calibration circuit of claim 29 wherein the first and second commands are each voltage pulses of decreased and increased voltages, respectively, relative to a threshold voltage.

39. The calibration circuit of claim 28 wherein the calibration circuit output is configured to provide an adjustable output current sink.

40. The calibration circuit of claim 39 wherein the adjustable output current sink is configured to sink more current responsive to an increase in the count in the up/down counter.

41. The calibration circuit of claim 28 wherein the controller is responsive to the first, second and third commands only when a controller enable signal received on a controller enable terminal enables the controller.

42. The calibration circuit of claim 28 wherein the calibration circuit is a single integrated circuit.

43. A calibration circuit for use in adjusting a common electrode voltage Vcom for a liquid crystal display (LCD) comprising:

a controller coupled to receive commands by way of a single-wire interface;

an up/down counter coupled to the controller;

electrically reprogrammable nonvolatile storage coupled to the controller and to an output of the up/down counter;

a digital to analog converter (DAC) having an input coupled to the output of the up/down counter, an output of the DAC being coupled to provide an adjustable calibration circuit current sink output;

the up/down counter having a power on reset for resetting the counter to a count stored in the nonvolatile storage on application of power to the calibration circuit;

the controller being responsive to a first pulse of reduced voltage from the single wire interface relative to a threshold voltage for at least a predetermined time to cause the counter to increase its count;

the controller being responsive to a second pulse of increased voltage from the single wire interface relative to a threshold voltage for at least a predetermined time to cause the counter to decrease its count;

the controller being responsive to a programming voltage pulse from the single wire interface to cause the nonvolatile storage to store a count from the up/down counter, the controller being configured to distinguish between the programming voltage pulse and the second pulse by sensing the rise in voltage above a voltage exceeding the voltage of a first pulse in less than the predetermined time.

44. The calibration circuit of claim 43 wherein the predetermined duration is 200 μsec.

45. The calibration circuit of claim 43 wherein the electrically reprogrammable nonvolatile storage is an EEPROM.

46. The calibration circuit of claim 43 wherein the adjustable output current sink is configured to sink more current responsive to an increase in the count in the up/down counter.

47. The calibration circuit of claim 43 wherein the controller will be responsive to the first, second and third commands only when a controller enable signal received on a controller enable terminal enables the controller.

48. The calibration circuit of claim 43 wherein the calibration circuit is a single integrated circuit.

* * * * *